US007347831B2

(12) United States Patent
Chiu

(10) Patent No.: US 7,347,831 B2
(45) Date of Patent: Mar. 25, 2008

(54) SHOE WITH MASSAGING AND WARMING ARRANGEMENTS

(76) Inventor: Hsao-Hsing Chiu, 3F., No. 8, Lane 82, Fuxing Rd., Wenshan District, Taipei City 116 (TW)

( * ) Notice: Subject to any disclaimer, the term of this patent is extended or adjusted under 35 U.S.C. 154(b) by 40 days.

(21) Appl. No.: 11/456,218

(22) Filed: Jul. 10, 2006

(65) Prior Publication Data

US 2008/0005936 A1 Jan. 10, 2008

(51) Int. Cl.
*A61H 7/00* (2006.01)
*A61F 5/14* (2006.01)

(52) U.S. Cl. ..... 601/15; 601/30; 601/46; 601/70; 36/2.6; 36/141

(58) Field of Classification Search ..... 601/15, 601/16, 22, 27, 28, 30, 46, 49, 60, 64, 67, 601/69, 70, 78, 79; 36/2.6, 136, 141; 607/111, 607/112, 114
See application file for complete search history.

(56) References Cited

U.S. PATENT DOCUMENTS 5,592,759 A * 1/1997 Cox ..... 36/141
5,913,838 A * 6/1999 Reilly ..... 601/58
5,956,866 A * 9/1999 Spears ..... 36/2.6
6,464,654 B1 * 10/2002 Montgomery et al. ..... 601/46
6,981,339 B2 * 1/2006 Szczesuil et al. ..... 36/2.6
7,152,345 B2 * 12/2006 Koenig ..... 601/46
7,264,599 B1 * 9/2007 Milligan ..... 601/28

* cited by examiner

*Primary Examiner*—Quang D. Thanh
(74) *Attorney, Agent, or Firm*—Leong C. Lei

(57) ABSTRACT

A ventilated shoe includes an outsole; an insole including projections; and a space defined by the insole and the outsole and including resilient pillars in the instep and interconnected the insole and the outsole, a battery compartment, second compartments, motor-driven vibrating devices located in the second compartments, an exposed first switch, a heating element, an exposed second switch, and a circuit board with the first and second switches provided on its edge. Turning on the first switch will activate the vibrating devices to vibrate the projections to perform a first operation to massage the sole. Turning on the second switch will activate the heating element to perform a second operation to warm the foot.

2 Claims, 6 Drawing Sheets

SHOE WITH MASSAGING AND WARMING ARRANGEMENTS

BACKGROUND OF THE INVENTION (a) Technical Field of the Invention

The present invention relates to shoes and more particularly to such a pair of ventilated shoes having massaging and warming arrangements.

(b) Description of the Prior Art

Shoes with ventilation system are well known. Shoes with massaging effect are also well known. Shoes with warming effect are also well known. However, so far as the present inventor is aware, a pair of shoes having all of the above effects has not been commercially available. Thus, continuing improvements in the exploitation of a pair of ventilated shoes with massaging and warming arrangements are constantly being sought.

SUMMARY OF THE INVENTION

The primary purpose of the present invention is to provide a pair of ventilated shoes having both massaging and warming arrangements.

To achieve the above and other objects, the present invention provides a sole assembly mounted in either one of a pair of shoes, comprising a plurality of openings formed on a periphery; an outsole; an insole including a plurality of perforations there through, and a plurality of projections provided proximate a toe portion and in a heel portion; and a space defined by and between the insole and the outsole and including a plurality of curved grooves, a plurality of resilient pillars provided in an instep and interconnected the insole and the outsole, a first compartment in the heel portion, a battery located in the first compartment, a plurality of second compartments smaller than the first compartment and located in the instep and in the toe portion, a plurality of vibrating devices located in the second compartments, a first switch electrically interconnected the battery and the vibrating devices and exposed on the periphery, a plurality of channels, a heating element fastened in the channels, a second switch electrically interconnected the battery and the heating element and exposed on the periphery, and a circuit board with the first and second switches provided on its edge; whereby turning on the first switch will activate the vibrating devices to vibrate the projections to perform a first operation to massage the sole, and turning on the second switch will activate the heating element to perform a second operation to warm the foot.

In one aspect of the present invention the second switch is a selection switch capable of operating in either 150° C. or 50° C.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
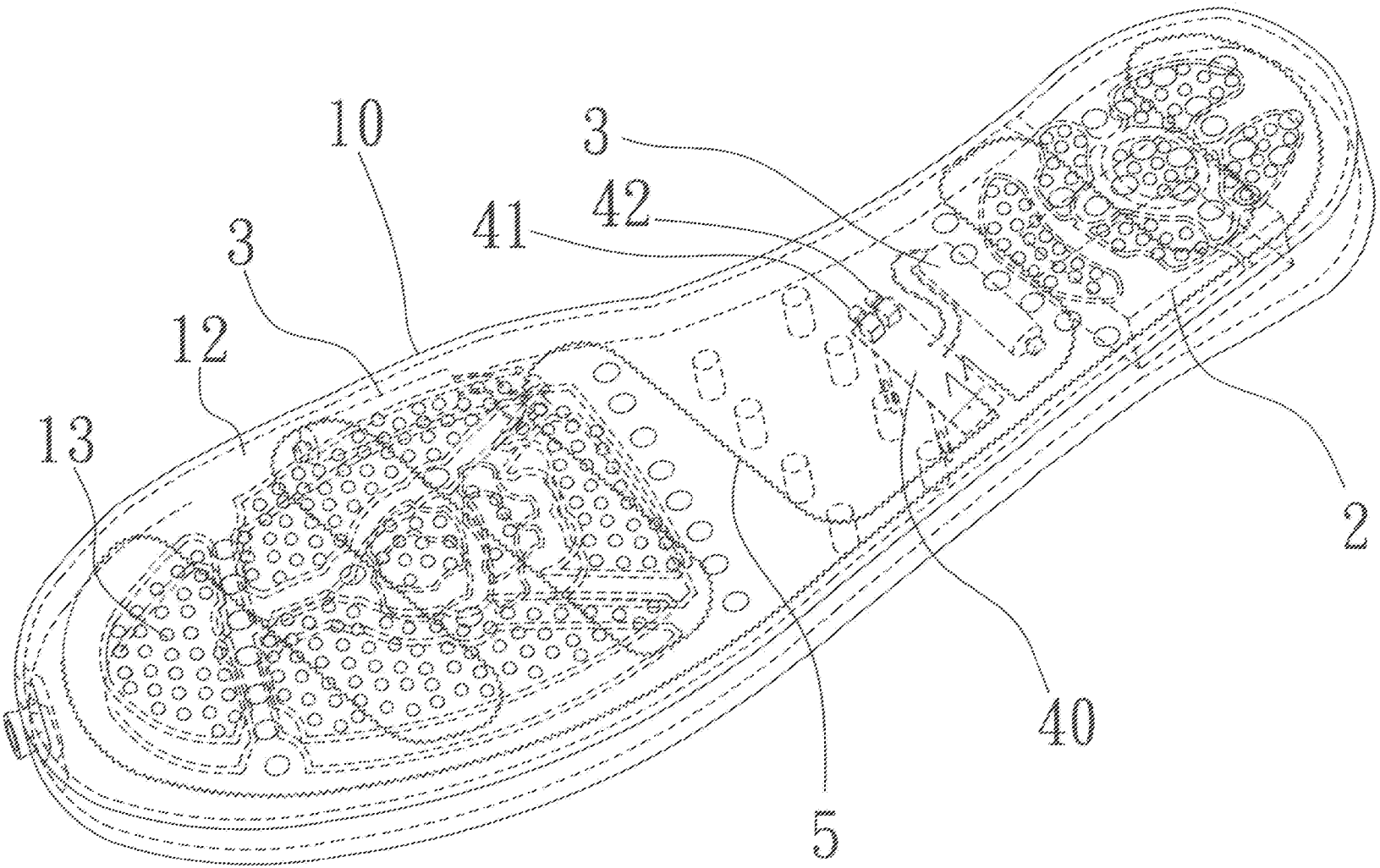
FIG. 1 is a perspective view of a preferred embodiment of sole assembly according to the invention.
Figure 2:
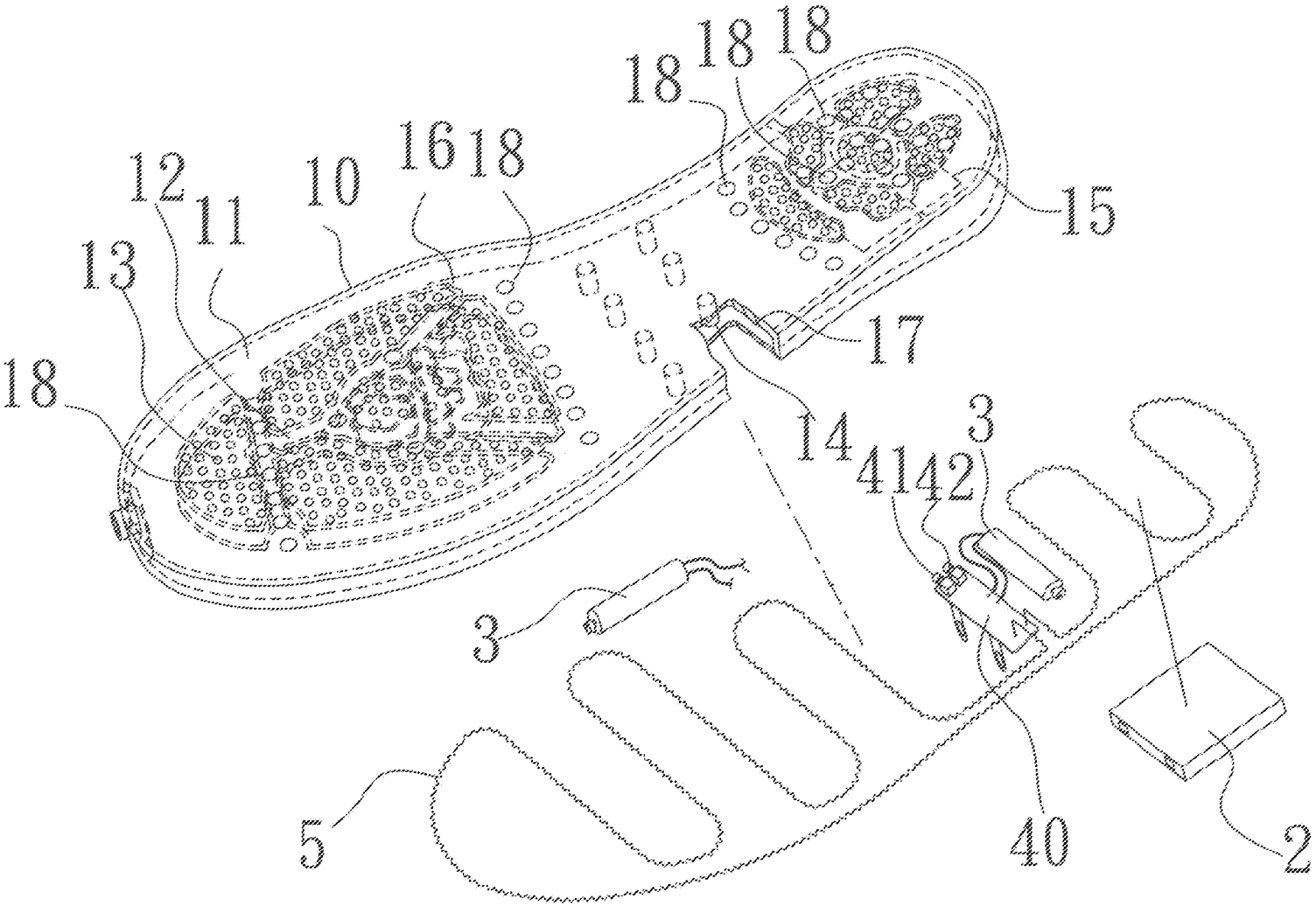
FIG. 2 is an exploded view of FIG. 1.
Figure 4:
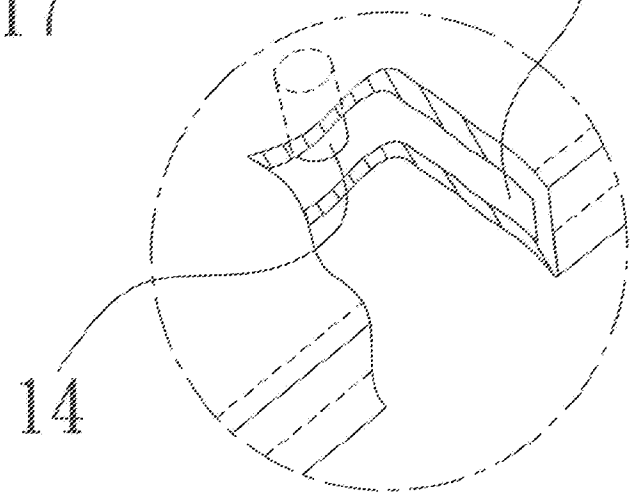
FIG. 4 is a detailed view of the area in circle "a" in FIG. 3.
Figure 3:
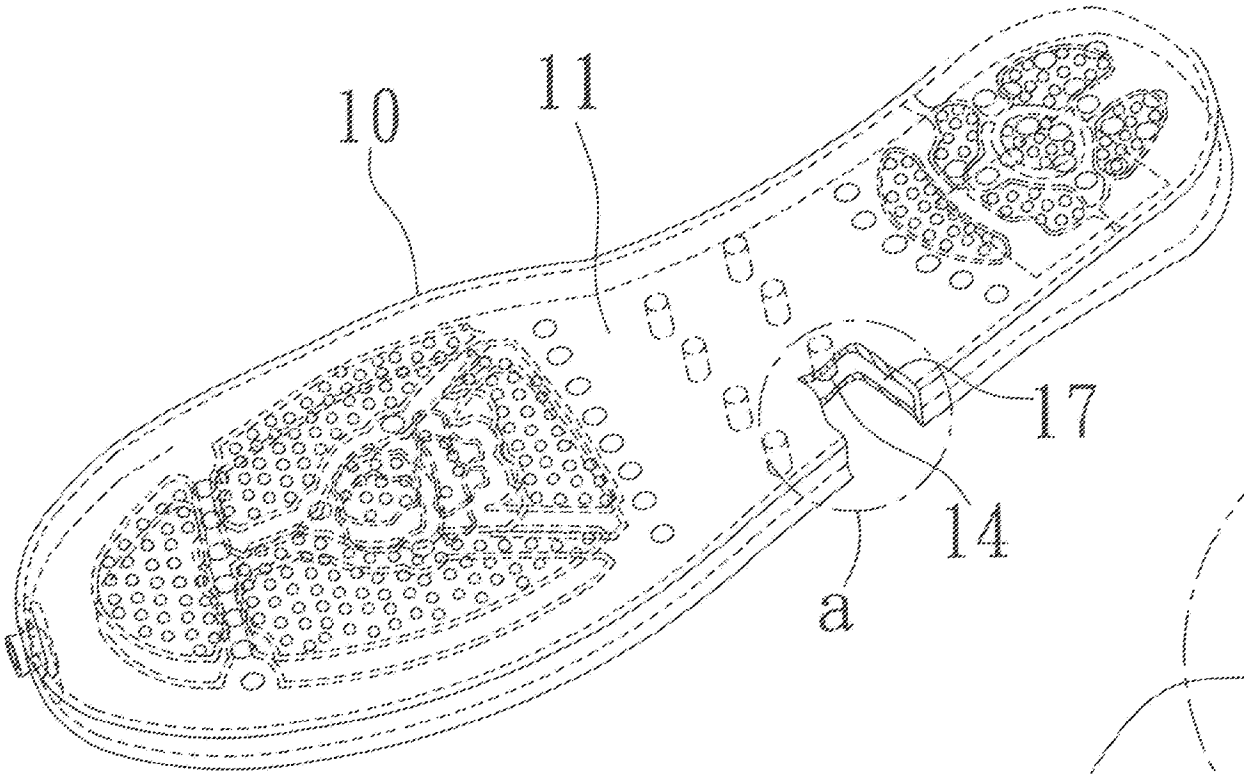
FIG. 3 is a partially broken away view of FIG. 1.
Figure 5:
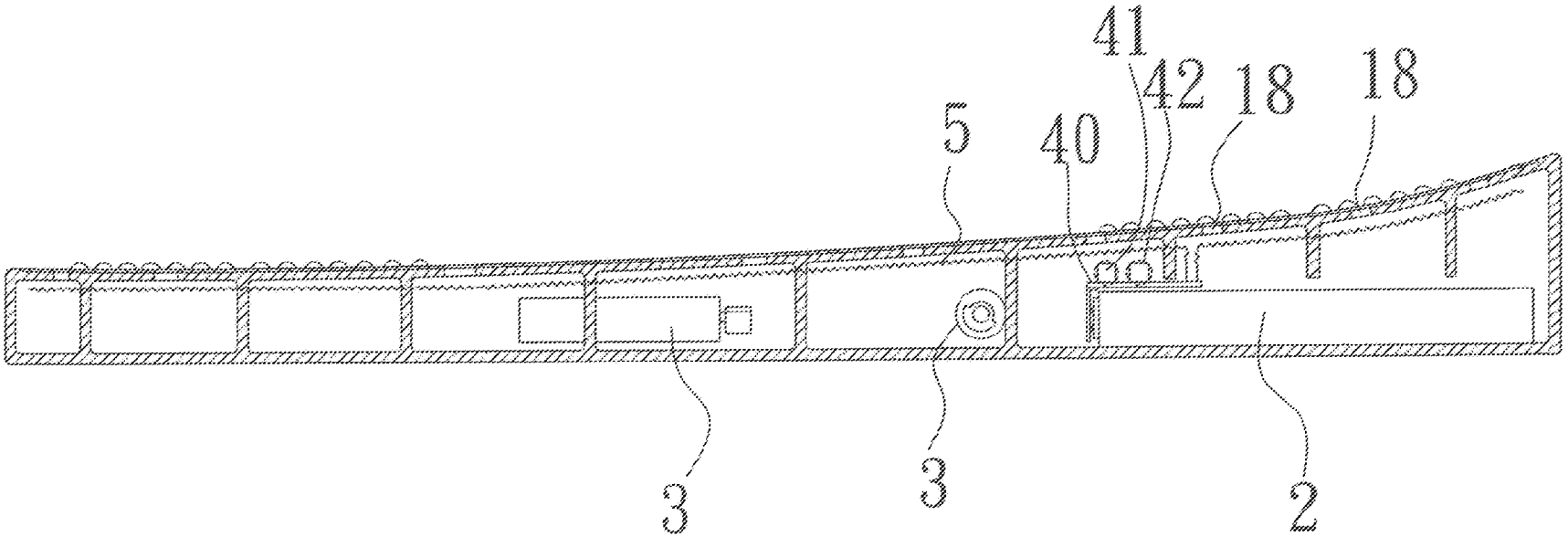
FIG. 5 is a longitudinal sectional view of FIG. 1.
Figure 6:
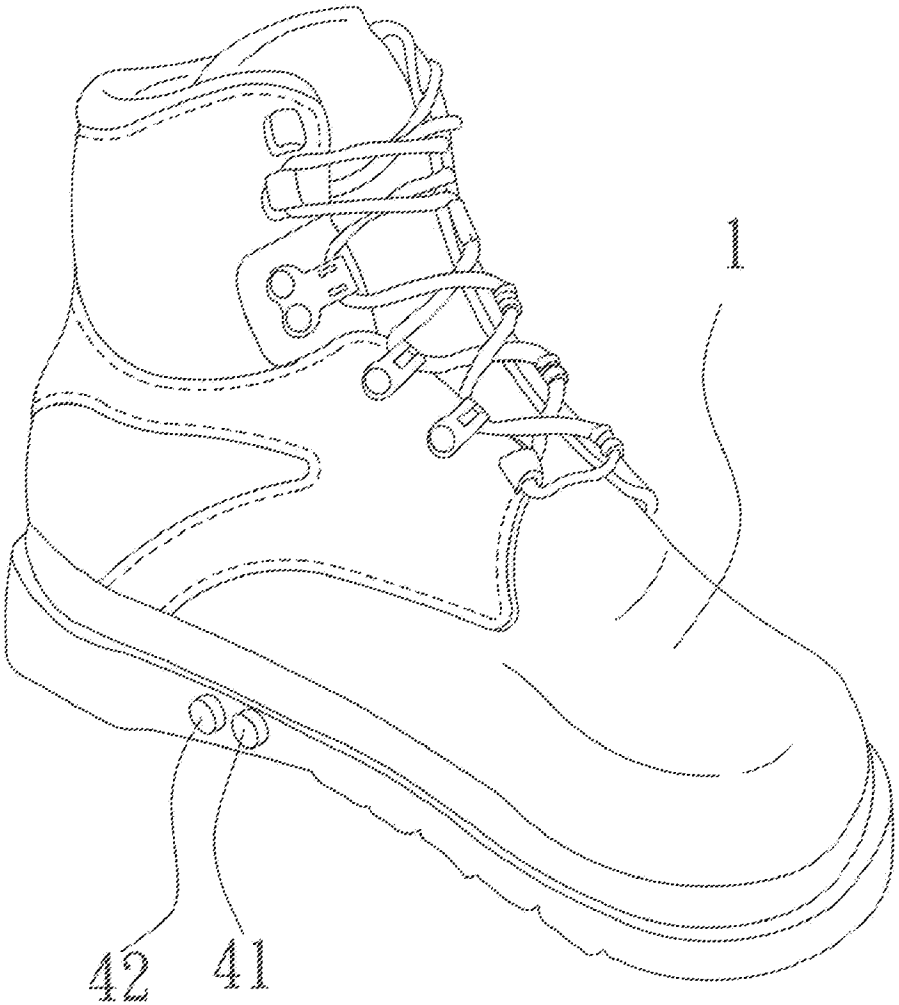
FIG. 6 is a perspective view of a shoe with the sole assembly assembled therein.
Figure 7:
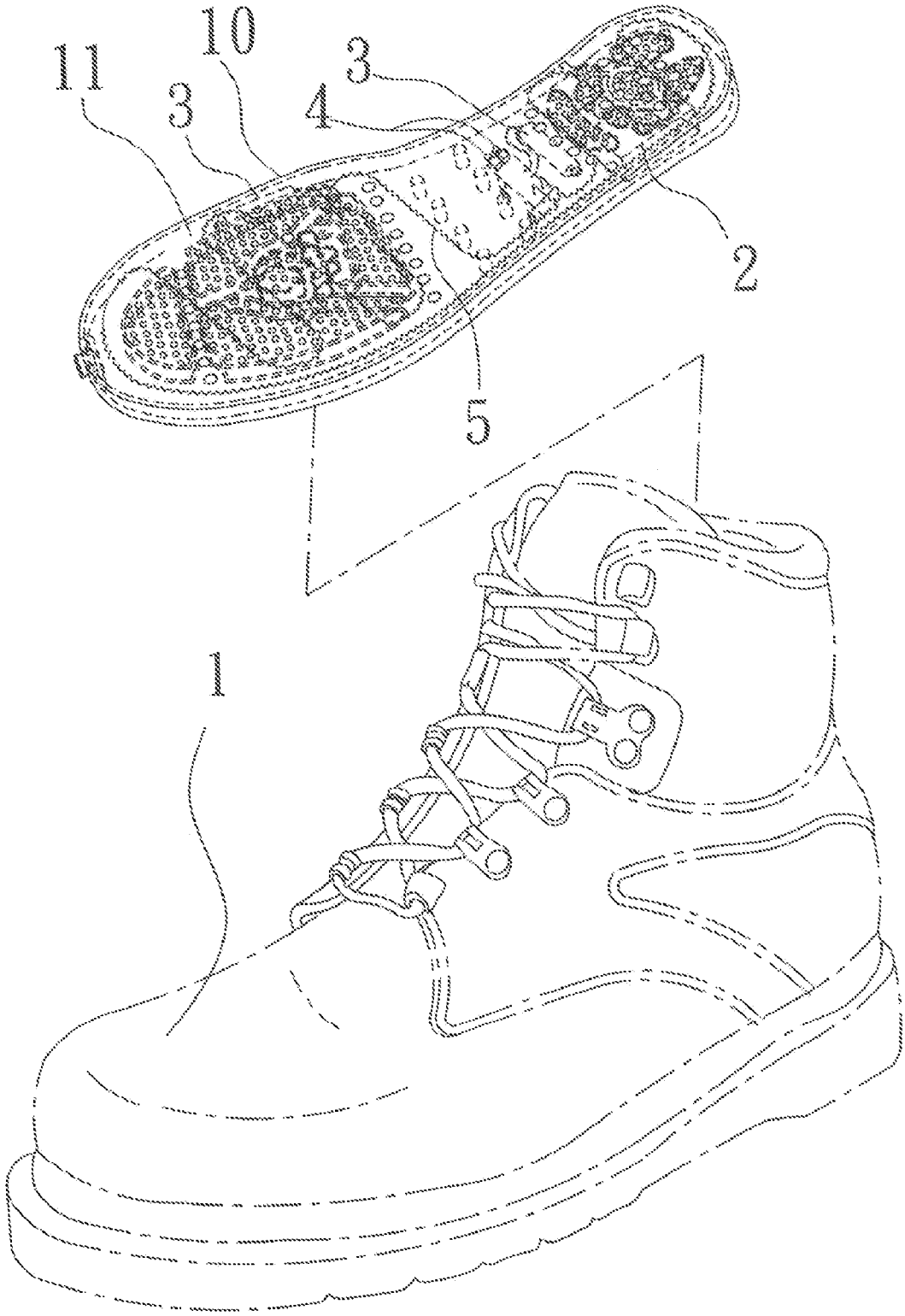
FIG. 7 is a perspective view of a shoe to be assembled with the sole assembly.

Referring to FIGS. 1 to 7, a shoe 1 in accordance with a preferred embodiment of the invention is shown. The shoe 1 comprises a sole assembly 10 as the subject of the invention. The sole assembly 10 is hollow and has a predetermined height. The sole assembly 10 comprises an insole 11 including a plurality of curved grooves 12 and a plurality of small projections 13 provided proximate a toe portion and in a heel portion. The provision of the projections 13 aims at massaging the sole of a wearer. The sole assembly 10 further comprises a plurality of resilient pillars 14 provided in an instep thereof and interconnected the insole 11 and an outsole. The provision of the pillars 14 aims at lessening the effect or absorbing the force of shocks while walking.

The sole assembly 10 further comprises a first compartment 15 in the heel portion. A battery 2 is located in the first compartment 15. A plurality of second compartments 16 smaller than the first compartment 15 are formed between the insole 11 and the outsole and located in the instep and the forepart. Two vibrating devices 3 are located in the second compartments 16. A first switch 41 is electrically interconnected the battery 2 and the vibrating devices 3. The first switch 41 is exposed on a periphery of the sole assembly 10 for case of operation. The first switch 41 is provided on an edge of a circuit board 40. The vibrating device 3 comprises a DC motor (not shown) and a cam shaft (not shown) driven by the motor for slightly vertically vibrating a bottom of the insole 11 when the vibrating device 3 is activating.

The sole assembly 10 further comprises a plurality of perforations 18 through the insole 11, a plurality of channels 17 formed between the insole 11 and the outsole, a heating element 5 fastened in the channels 17 and electrically connected to both the circuit board 40 and the battery 2, and a second switch 42 electrically interconnected the battery 2 and the heating element 5 and exposed on the periphery of the sole assembly 10 for ease of operation, the second switch 42 served as a switch for enabling the heating element 5 to heat the sole assembly 10 or not, and the second switch 42 provided on the edge of the circuit board 40 adjacent the first switch 1. The second switch 42 is implemented as a high and low selection switch so as to heat the sole assembly 10 to, for example either 150° C. or 50° C.

In use, a wearer may turn on the first switch 41 to activate the vibrating devices 3 to perform a first operation to massage the sole in cooperation with the projections 13. Further or alternatively, the wearer may turn on the second switch 42 to activate the heating element 5 to perform a second operation to warm the cold foot in either first temperature of 150° C. or second temperature of 50° C. The second operation is particularly applicable to cold weather. In either operation, air is drawn into the internal space including the grooves 12 of the sole assembly 10 through the perforations 18 prior to expelling out of same through a plurality of openings (not shown) formed on a periphery of the sole assembly 10. In brief, the provision of grooves 12 and perforations 18 aims at facilitating ventilation.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A sole assembly mounted in either one of a pair of shoes, comprising:

a plurality of openings formed on a periphery;

an outsole;

an insole including a plurality of perforations therethrough, and a plurality of projections provided proximate a toe portion and in a heel portion; and a space defined by and between the insole and the outsole and including a plurality of curved grooves, a plurality of resilient pillars provided in an instep and interconnected the insole and the outsole, a first compartment in the heel portion, a battery located in the first compartment, a plurality of second compartments smaller than the first compartment and located in the instep and in the toe portion, a plurality of vibrating devices located in the second compartments, a first switch electrically interconnected the battery and the vibrating devices and exposed on the periphery, a plurality of channels, a heating element fastened in the channels, a second switch electrically interconnected the battery and the heating element and exposed on the periphery, and a circuit board with the first and second switches provided on its edge;

whereby turning on the first switch will activate the vibrating devices to vibrate the projections to perform a first operation to massage the sole, and turning on the second switch will activate the heating element to perform a second operation to warm the foot.

2. The sole assembly of claim 1, wherein the second switch is a selection switch capable of operating in either 150° C. or 50° C.

* * * * *